United States Patent [19]

Kümmel et al.

[11] Patent Number: 5,060,025

[45] Date of Patent: Oct. 22, 1991

[54] SINGLE-SHEET PAGE PRINTER FOR DUPLEX AND SIMPLEX OPERATION

[75] Inventors: Klaus Kümmel; Gerhard Klapettek, both of Giessen; Siegfried Schneider, Biebertal, all of Fed. Rep. of Germany

[73] Assignee: Siemens Aktiengesellschaft, Munich, Fed. Rep. of Germany

[21] Appl. No.: 566,383

[22] Filed: Aug. 28, 1990

[30] Foreign Application Priority Data

Mar. 2, 1988 [WO] PCT Int'l Appl. ... PCT/DE88/00111

[51] Int. Cl.[5] ..... G03G 15/00

[52] U.S. Cl. ..... 355/319; 271/3

[58] Field of Search ..... 355/318, 319, 320, 321, 355/322, 24, 26, 313; 358/296; 271/3, 3.1, 298, 301

[56] References Cited

U.S. PATENT DOCUMENTS 4,593,407 6/1986 Konishi et al. ..... 382/46
4,696,563 9/1987 Shibusawa ..... 355/311

FOREIGN PATENT DOCUMENTS 0139223 5/1985 European Pat. Off. .
58-105248 6/1983 Japan .
63-8132 1/1988 Japan ..... 271/3

*Primary Examiner*—Joan H. Pendegrass
*Attorney, Agent, or Firm*—Hill, Van Santen, Steadman & Simpson

[57] ABSTRACT

Printing apparatus for printing one or both sides of single sheets fed consecutively to the printing apparatus, with a printing channel with an associated printing station and paper-transport elements. The printing channel is coupled on the entry and exit sides to a return channel which has paper-transport elements and a turning device and which, as required, after the printing of a front side feeds the single sheets to the printing station once again for the printing of the reverse side. The printing channel is followed by a paper-transport channel system having paper-transport elements and with a separate duplex channel and simplex channel for the separate transport of the single sheets printed on both sides or on one side into a common output channel with a second turning station for the duplex sheets. The simplex channel has a paper storage device which stores a first single sheet printed on one side at least until a single sheet to be output via the output channel before this single sheet and printed on both sides has run through the duplex channel.

15 Claims, 8 Drawing Sheets

SINGLE-SHEET PAGE PRINTER FOR DUPLEX AND SIMPLEX OPERATION

Figure 1:
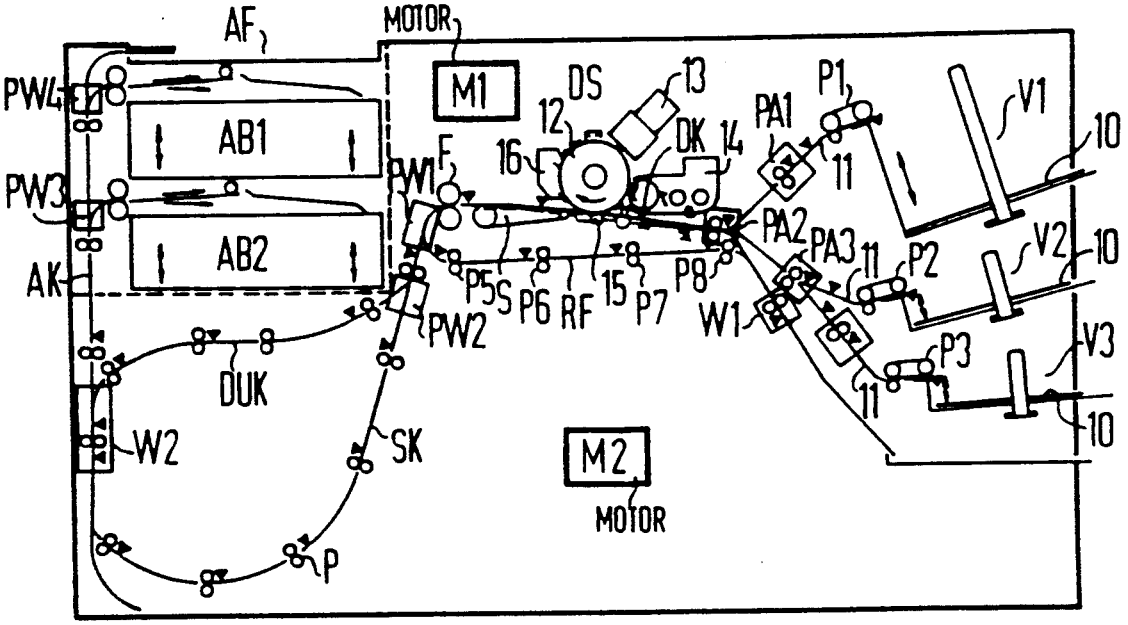

The invention relates to a single-sheet page printer for duplex and simplex operation.

In electrophotographic printers, in the duplex mode the single-sheet extracted from a stock container is first printed on the front side in the printing channel of the printing apparatus, is then returned to the entrance of the printing channel via a return channel and is turned in a turning device located there. After a new feed into the printing channel, the reverse side of the single sheet is then printed. The single sheet is thereafter deposited in an output container via an output channel.

In order to maintain a continuous printing operation at a constant printing process speed, one or more sheets are fed continuously to the printing channel and to the return device. The control of the printer then assigns the appropriate printing image to the corresponding front and reverse sides of the single sheets. The correct sequence of delivery or depositing is guaranteed by guiding all the sheets to be printed through the printing channel and the return channel, including the turning device.

In mixed printing orders, that is to say in printing orders containing both simplex and duplex printing, there is the disadvantage that all the sheets, even those to be printed on only one side (simplex), are moved past the printing station a second time. In the most adverse circumstances, the processing speed of such a page printer is thereby reduced to virtually half its output which would otherwise be possible in pure simplex operation. If, for example, the printing order contains mostly single sheets printed on only one side and otherwise only a small number of single sheets to be printed on both sides, the entire printing order nevertheless has to be executed in the duplex mode.

If, in the mixed mode, the non-printed reverse sides are not returned via the return channel, but are delivered directly, the entire printing order has to be sorted in the delivery container after delivery. This can be carried out manually only at a considerable outlay. Sorting devices otherwise necessary are of complicated construction and require a high outlay in terms of attendance.

Moreover, with electrophotographic printing apparatuses it is possible to print pre-printed forms. These can, for example, be publicity brochures with personal data, invoices, tax forms or the like.

In the form-printing mode, with known page printers the form stack to be printed must, in the mixed mode and in the pure duplex mode, be stacked in the stock container with the front side of the individual forms face-down, so that, after a double run through the printing channel, the stack is stacked correctly in terms of side and position on the supply side. In this case, correctly in terms of side and position means that the first sheet to be printed is deposited in the delivery container with its front side face-down.

When there is a form stack to be printed on only one side, it is therefore necessary, with only one run through the printing channel for each single sheet, to deposit the form stack in the stock container with the side to be printed face-up. For this, it is assumed that, in the printing channel, the actual printing station is arranged above the printing channel.

The operator, when introducing a form stack, must therefore be aware of the exact construction of the stack and deposit this in the stock container correspondingly correctly in terms of position. This is complicated and can lead to errors.

Page printers for single-sheet operation are of relatively complicated construction in terms of the paper transport, and moreover the necessary tolerances in the paper channel are only very narrow. Such page printers with a printing speed of 50 pages per minute or above are operated round the clock by shift work. It is therefore necessary for printing apparatuses of this type to be designed for easy attendance, so that a paper-transport fault occurring, for example, as a result of tears of the paper or damage to it can be rectified quickly.

An object of the invention is to provide a single-sheet page printer for duplex and simplex operation of a high printing speed and high printing quality, which, even in mixed mode, allows a high printing speed with rapid continuous sheet delivery.

A further object of the invention is to design the single-sheet page printer in such a way that a delivery that is correct in terms of the sequence and side position of the single sheets is guaranteed, especially in a form-printing mode in which a stack of forms of predetermined sequence and side position is fed to the printer.

Furthermore, the printer is to be designed for easy attendance, so that especially faults in the paper run can easily be detected and rectified.

In a printing apparatus of the type mentioned at the beginning, this object is achieved by a printing apparatus for printing one or both sides of single sheets fed consecutively to the printing apparatus in a mixed sequence of single sheets to be printed both on one side and on both sides, having: a printing channel with an associated printing station and paper-transport elements; coupled to the printing channel on the entry and exit sides is a return channel which has paper-transport elements and a turning device and which, as required, after the printing of a front side feeds the single sheets to the printing station once again for the printing of the reverse side. The printing channel is followed by a paper-transport channel system having paper-transport elements and by a separate duplex channel and simplex channel for the separate transport of the single sheets printed on both sides or on one side into a common output channel. The simplex channel includes a paper storage device in which a single sheet printed on one side following a single sheet printed on both sides in the sequence of printed single sheets is stored. Also included is a control arrangement for controlling the output sequence of the single sheets to the output channel until the single sheet printed on both sides has run through the duplex channel.

Advantageous embodiments of the invention are provided by, for example, a paper storage device which is designed as a storage channel for receiving the single sheets consecutively. The paper storage device may be a storage container, with paper extraction and paper-feed elements. In the printing apparatus, the duplex and/or the output channel has a further turning device in a preferred arrangement.

Other advantages are provided by a feed channel connected to the printing channel and with a paper-aligning device, the single sheets extracted from the stock containers being positioned in the paper-aligning device and then fed to the printing channel. The present device may have a paper-aligning device arranged in the printing channel in front of the printing station. As a further improvement, the printing apparatus paper-aligning device has a motor-driven pair of paper rollers with a paper-position sensor preceding it in the paper-transport direction. A control arrangement, which is provided with the pair of stationary paper rollers, presses a leading edge of a single sheet of paper for a predetermined time, as a function of the output signal from the paper-position sensor, via paper-transport element preceding the paper sensor in the paper-transport direction, and the single sheet thus aligned is then transported further by the pair of paper rollers.

The printing apparatus, in a preferred embodiment, includes paper-transport elements of variable transport speed and reversible transport direction, with a pair of rollers consisting of a pressure roller and a transport roller, and with a first and a second electrically actuable coupling. A drive motor is coupled via a drive means to the driving side of the couplings and the transport roller is coupled via drive means to the driven side of the couplings. It is contemplated that the driving roller be made of metal and the pressure roller be made of flexible plastic.

A further advantage is provided in the printing apparatus of the invention wherein the return channel transports the single sheets at a speed substantially higher than the printing process speed. Paper-position sensors arranged in the paper-transport channels and detecting the position of the single sheets are preferred. If there is a fault in the printing operation as a result of defective paper transport, the fault location is shown via the paper-position sensors on an indicator device representing the paper run. The printing apparatus may include a separately controllable waste/delivery container.

Another feature of the invention provides a delivery container for different paper formats with paper-transport elements arranged on the entry side and with a pivotable guide device which, as a function of the paper format, transports single sheets of large paper formats to a stop edge directly and single sheets of small formats to the said stop edge via an additional paper-transport element.

In the printing apparatus according to the invention, only the pages to be printed are fed to the printing station. That is to say, even in the mixed mode, sheets to be printed on only one side, after being printed, are no longer transported into the printing channel again via a return channel and a turning station, but, after being printed, they are fed to a simplex channel. This simplex channel is designed as a storage device and opens into the delivery device via an output device. Now if, in the sequence of the printing process, the single sheet to be printed on only one side is preceded by a single sheet to be printed on both sides, the single sheet to be printed on only one side is stored in the simplex channel until the single sheet previously to be output or delivered and to be printed on both sides has been printed on both sides and fed to an output channel via a separate duplex channel.

The storage device in the simplex channel can in this case consist of an intermediate container which can be fed with individual sheets and from which the individual sheets can again be extracted, or advantageously of an elongated storage channel, in which the single sheets to be printed on one side can be stored in succession. The simplex sheets are introduced from the simplex channel into the output channel as a function of the sequence of duplex sheets in the printing order.

In an advantageous embodiment of the invention, the duplex channel has a further turning device.

This additional turning device, in conjunction with the storage device of the simplex channel, makes the processing of forms substantially easier. Form stacks can now always be deposited in the stock container with the front side face-up, independently of their composition of single sheets being printed on the one side and single sheets being printed on both sides. The form stack is then printed and delivered in such a way that the first sheet to be printed is always located in the delivery container with its front side face-down.

In a further advantageous embodiment of the invention, located in the entry region of the printing channel or in the feed channel to the printing channel is a paper-aligning device which correctly positions the single sheets extracted from the stock container before they are fed to the printing channel.

A positionally correct print on the single sheets thereby becomes possible. As a result of the exact position of the single sheets, it is possible, furthermore, to reduce the distance from single sheet to single sheet in the printing channel and thus increase the printing speed.

The paper-aligning device consists in a simple way of a pair of paper rollers with a preceding paper-position sensor, the single sheet being pressed against the stationary pair of paper rollers, It arches and aligns itself along the rollers.

So that the printing speed can be increased further, in a further advantageous embodiment of the invention the single sheets to be printed on both sides are transported in the return channel at a speed substantially higher than the printing process speed.

Sensors distributed in the printing channel detect the position of each single sheet during the run through the printing apparatus. If an interruption of the printing operation occurs as a result of a fault in the paper transport, the position of the fault is displayed on an indicator device representing the paper run. It is thus possible to locate the fault quickly and reliably.

So that paper formats of differing size can be processed and delivered, in a further embodiment of the invention the delivery containers possess, in the region of the paper-transport elements arranged on the entry side, a pivotable guide device which, as a function of the paper format, guides single sheets of large formats directly up to a stop edge of the delivery container. Small paper formats are guided by the guide device past an additional paper-transport roller which accelerates the paper sheets once again and which thus likewise deposits them against top edge of the paper-delivery container.

Embodiments of the invention are illustrated in the drawings and described in detail below by way of example.

In the drawings

Figure 2:
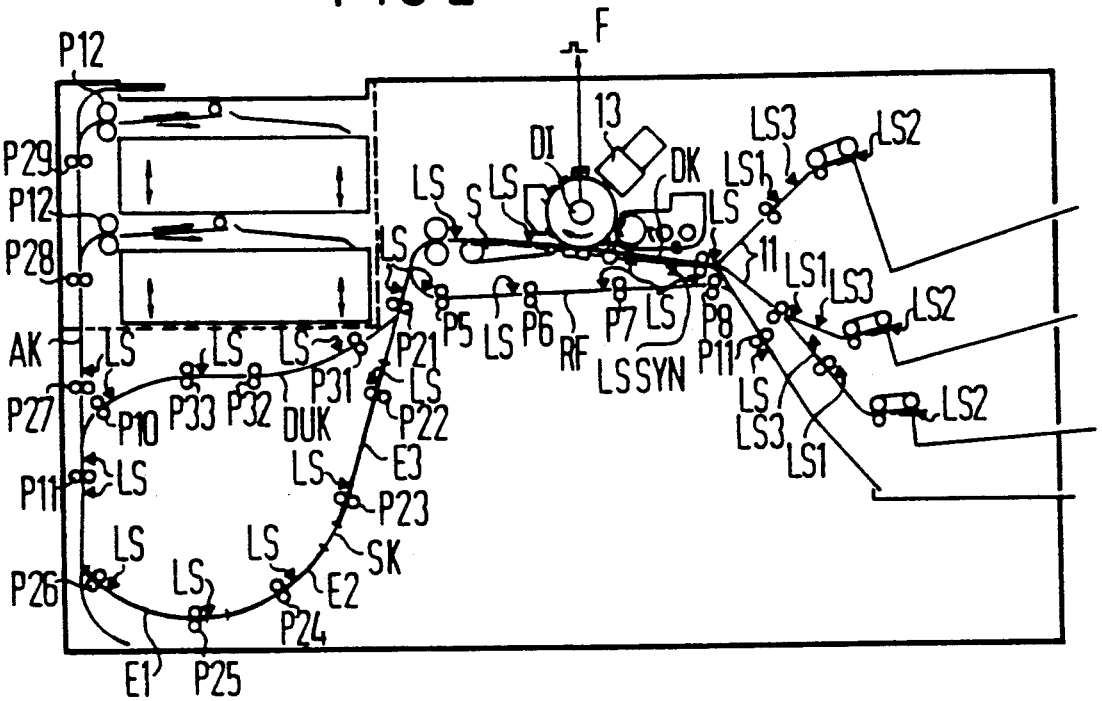
Figure 3:
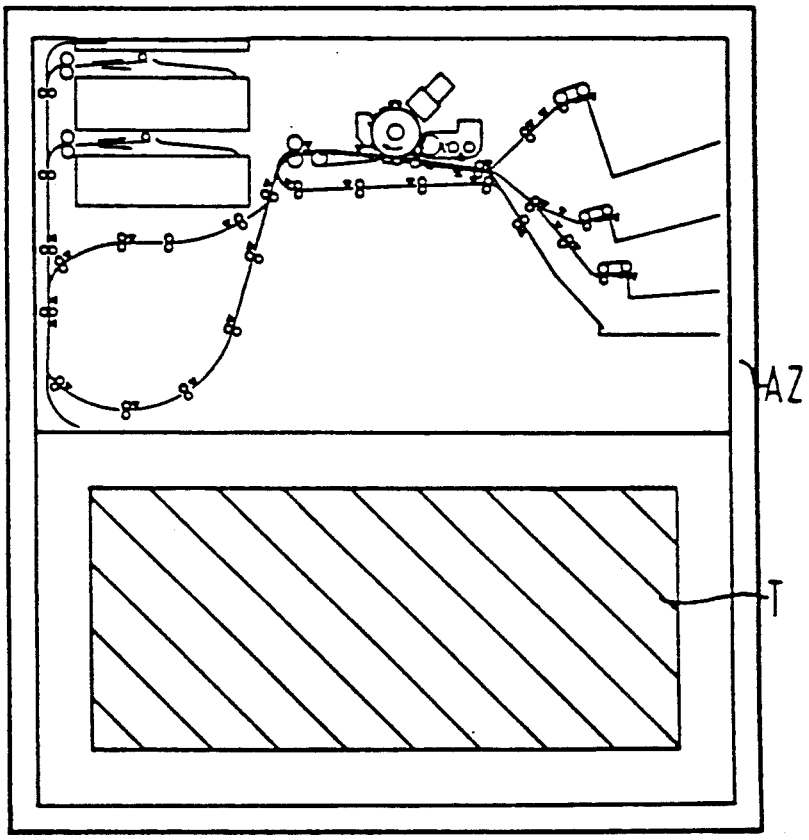
Figure 4:
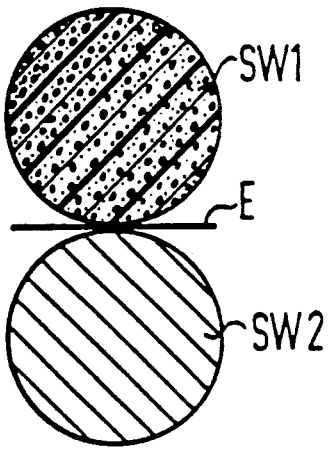
Figure 5:
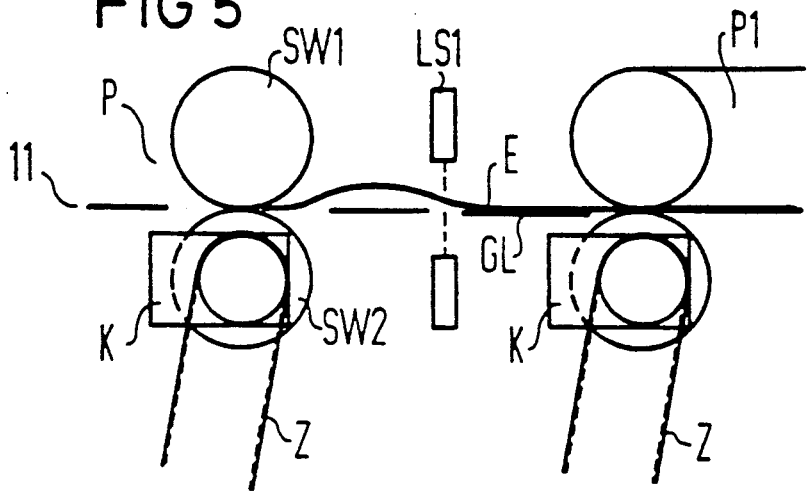
Figure 6:
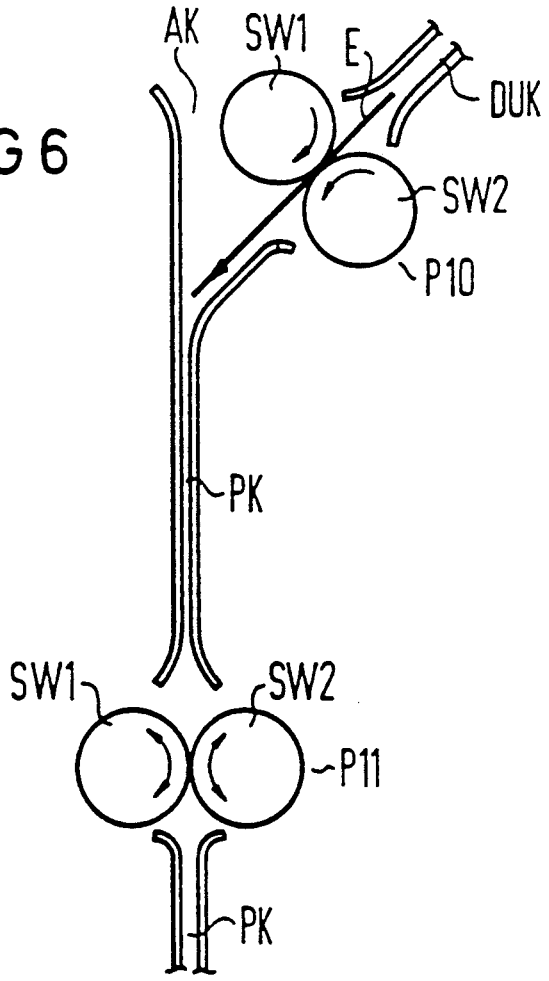
Figure 7:
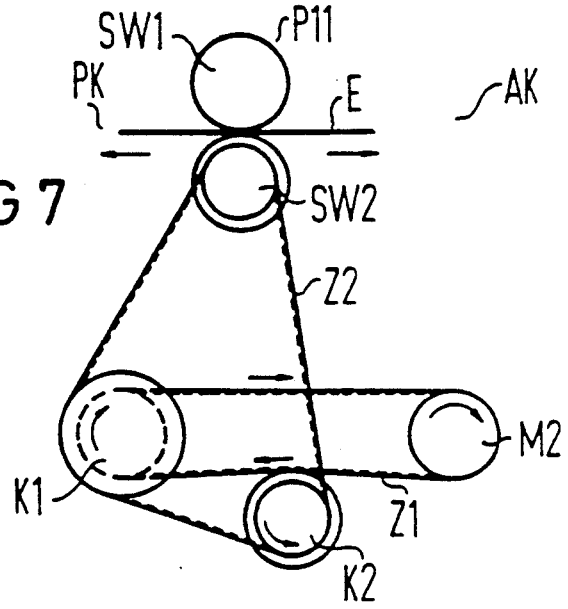
Figure 8:
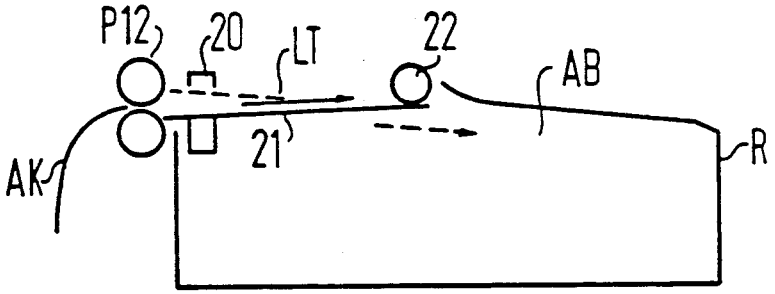
Figure 9:
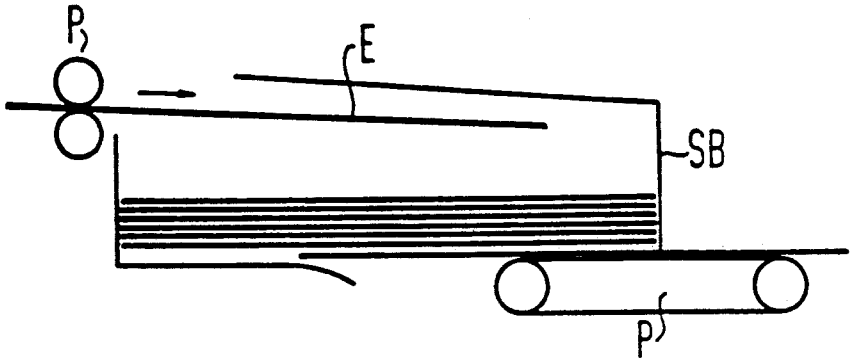
Figure 10:
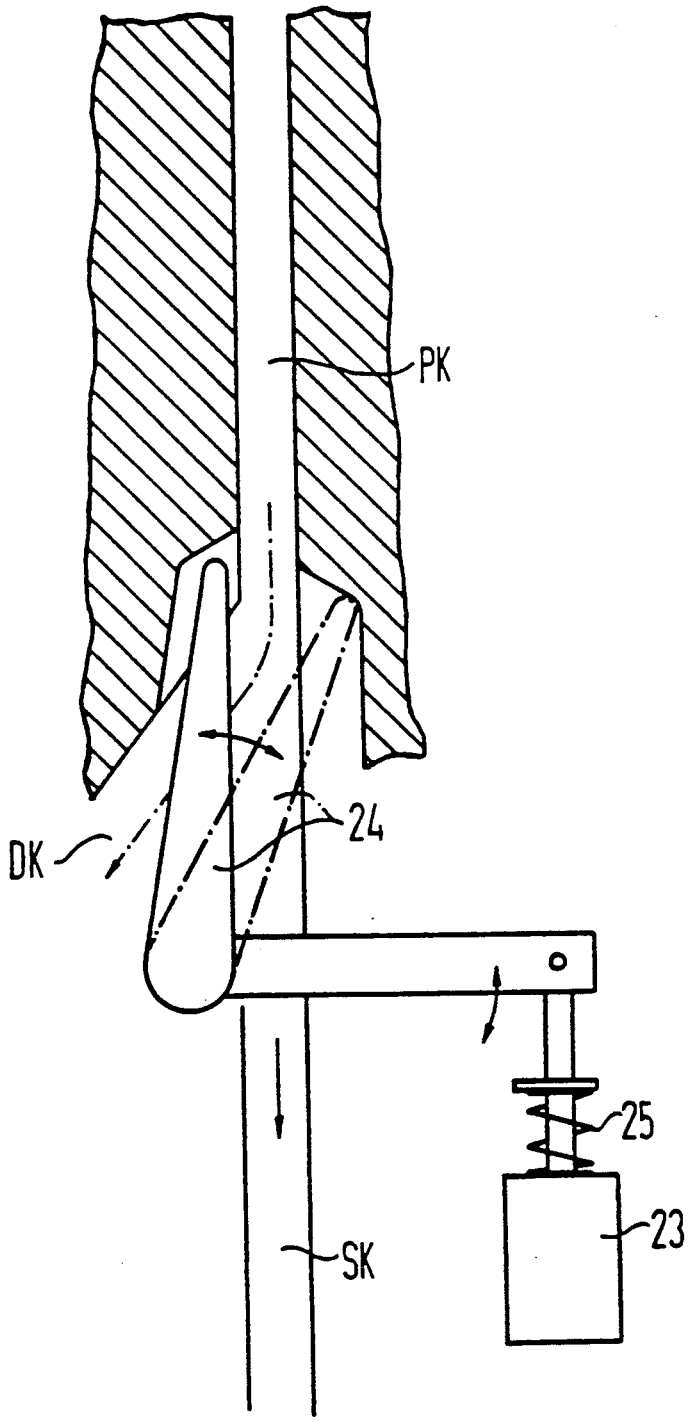
Figure 11:
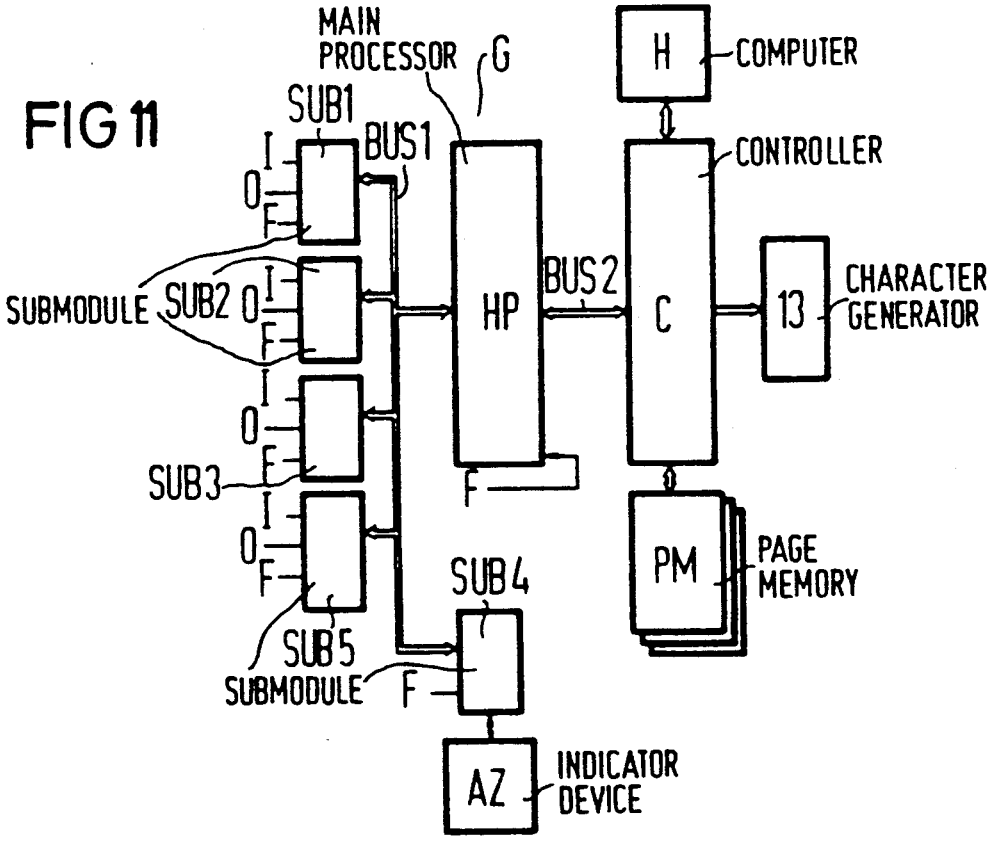
Figure 12:
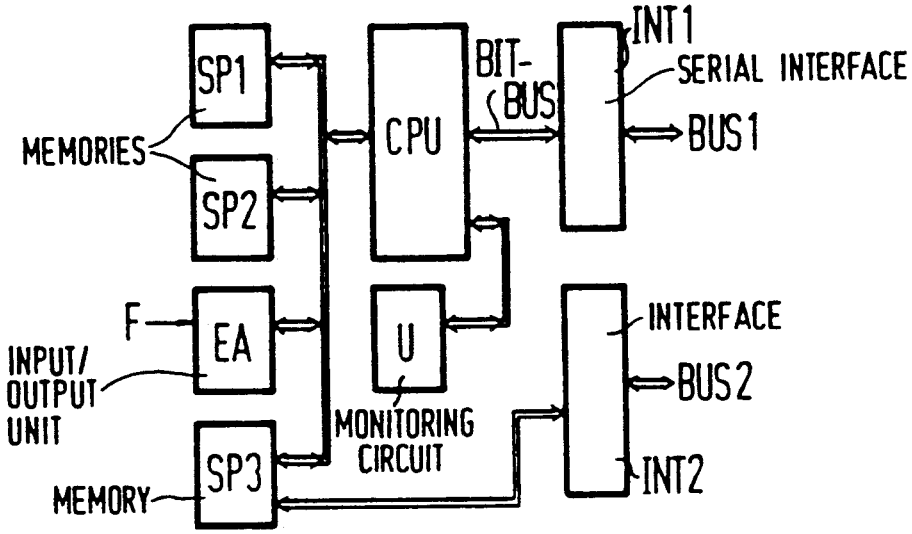
Figure 13A:
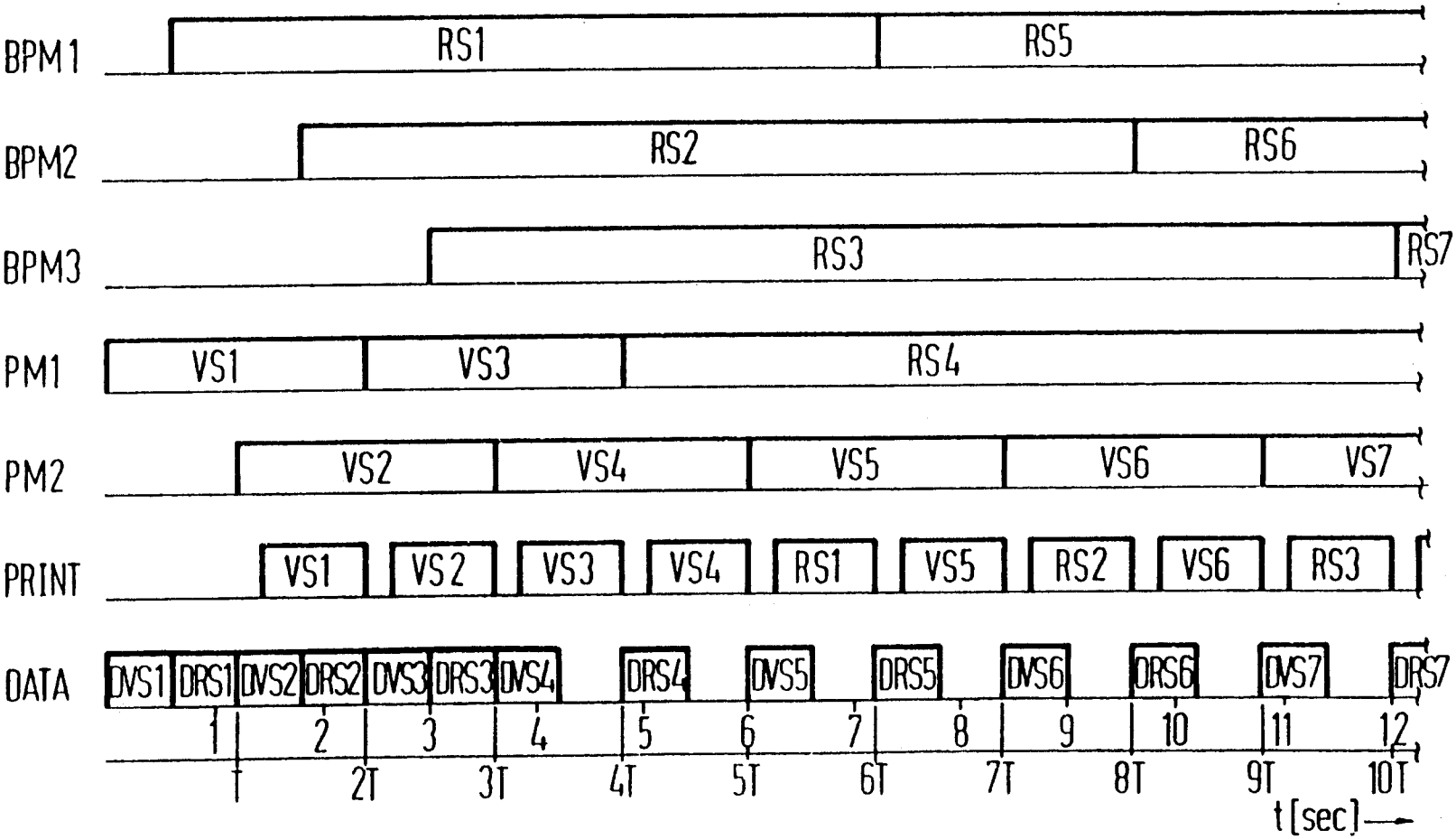
Figure 13B:
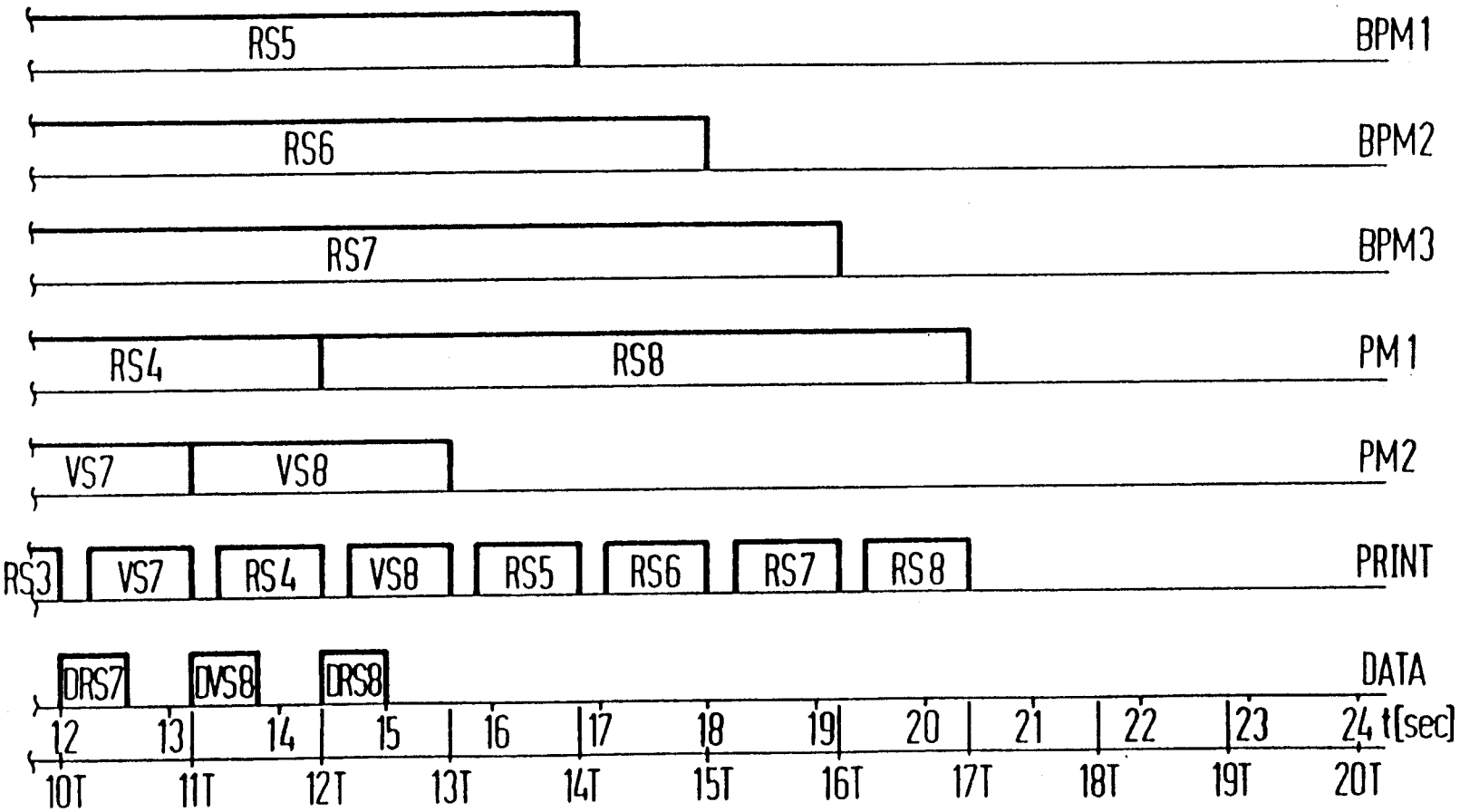

FIG. 1 shows a diagrammatic sectional representation of the single-sheet printing apparatus FIG. 2 shows a diagrammatic sectional representation of the paper run with the sensors and the paper-transport elements FIG. 3 shows a diagrammatic representation of the indicator and input device on the printing apparatus FIG. 4 shows a diagrammatic sectional representation of a pair of paper-transport rollers FIG. 5 shows a diagrammatic sectional representation of a paper-aligning device FIG. 6 shows a diagrammatic sectional representation of a turning device FIG. 7 shows a diagrammatic sectional representation of a gear driving a turning device FIG. 8 shows a diagrammatic sectional representation of a delivery container FIG. 9 shows a diagrammatic sectional representation of a storage device for single sheets FIG. 10 shows a diagrammatic sectional representation of a paper switch FIG. 11 shows a block diagram of the control arrangement for the single-sheet printer FIG. 12 shows a block diagram of the main processor of the control arrangement of FIG. 11, and FIGS. 13*a* and 13*b* show a diagram of the occupancy of the page store as a function of the printing data supplied over time.

The single-sheet page printer illustrated in FIG. 1 and working on the principle of electrophotography contains three paper stock containers V1, V2 and V3 of differing capacity for the reception of single sheets. The paper stock containers V1, V2, V3 are of conventional construction and have a motor-driven baseplate 10 displaceable in the direction of the arrow according to the paper stock. A paper stack arranged in the paper stock container is thereby raised according to the consumption of the paper, so that the uppermost single sheet of the paper stack can always be drawn off from the paper stack via paper-transport elements P1, P2 and P3. The paper stock containers are connected via paper-feed channels 11 to a printing channel DK of the printing apparatus. The printing channel DK contains the actual printing station DS with an electrophotographic printing device consisting of a photoconductor drum 12, of an exposure station 13 with a LED comb not shown here and activatable in a character-dependent manner, of a developer station 14, of a transfer-printing station 15 and of a cleaning station 16. Furthermore, the printing channel DK contains paper-transport elements in the shape of a suction table S rotating in band form and, on the entry side, a paper-aligning device PA2, the function of which is described later, and a fixing station F consisting of electrically heated heating rollers which are driven electromotively and which thermally fix in a known way a toner image transfer-printed on a recording carrier (single sheet).

Coupled to the printing channel DK on the entry and exit sides is a return channel RF containing paper-transport elements P5–P8 in the form of motor-driven pairs of rollers. The return channel RF possesses, furthermore, a turning device W1, the function of which is explained later.

The printing channel DK is followed by a paper-transport channel system activated via a paper switch PW1 and having a separate duplex channel DUK and a separate simplex channel SK which terminate in a common output channel AK. The single sheets printed on both sides are transported in the duplex channel DUK, and the single sheets printed on one side are transported in the simplex channel SK. The duplex and the simplex channels are activated by a switch PW2. The simplex channel SK is designed as an elongate paper channel, with paper-transport elements arranged in it. It can receive up to three single sheets in succession and serves as a storage channel. A further turning device W2 is located at the end of the duplex channel. This turning device W2 connects the duplex channel to the output channel Ak.

The output channel AK has switches PW3 and PW4 which guide the single sheets into two delivery containers AB1 and AB2. Furthermore, a waste container AF (copy tray) activated by the switch PW4 is provided.

To determine the position of the single sheets running through the printer and to control the paper-transport elements P, all the paper channels have paper sensors LS (shown as black triangles) which consist of light barriers, see FIG. 2. The output signals from these sensors LS are evaluated by an evaluation circuit explained later, and an indicator device AZ is thereby controlled. The indicator device AZ (FIG. 3) is located on the front side of the printer and also has an input keyboard T.

Furthermore, arranged in the feed channel 11 of the stock containers and at the entrance of the printing channel are paper-aligning devices PA1 to PA3 which serve for aligning the single sheet in the correct position in the printing channel DK before printing.

All the paper-transport elements P, including the fixing station F and the photoconductor drum 12, are driven via two motors M1 and M2. The motor M1 drives the paper-transport elements in the printing channel and in the input region, whilst the motor M2 drives the paper-transport elements in the return channel RF, in the duplex channel DUK, in the simplex channel SK and in the output region AK. All the paper-transport elements (pairs of paper rollers P) have electrically controllable couplings, for example spring-band couplings, and are connected to the two associated motors M1 or M2 via toothed belts which are not shown here for the sake of clarity. The paper-transport elements consist of a pair of rollers (FIG. 4) with an upper foam roller SW1 and a lower driven roller SW2 made of aluminum, between which the single sheet E is transported by friction.

The construction of the individual elements of the printing apparatus is now described in more detail below.

Paper-aligning device (FIG. 5)

Paper-aligning devices PA1 to PA3 of FIG. 1 are arranged in the paper-feed channels 11 of the stock containers V1–V3 and at the entrance of the printing channel DK. They serve for aligning single sheets E extracted from the stock containers V1 to V3 and for feeding them in aligned form to the printing station DS.

They have the construction shown in principle in FIG. 5 and consist of an actual pair of paper-transport rollers P composed of a foam roller SW1 and of a driven aluminum roller SW2. The driven roller SW2 is connected, via a coupling K which can consist of an electrically actuated spring-band coupling, to a toothed belt Z driven by the motors M1 or M2. Furthermore, the coupling K contains a brake which ensures that, when the non-positive connection between the motor and driving roller SW2 is broken, the driving roller SW2 is braked and its rotation therefore slowed down.

Arranged in front of the paper rollers P and offset at a distance in the paper-transport direction is a photoelectric sensing device LS1, the output signal of which is evaluated by the apparatus control of the printer. The sensing device LS1 senses the leading edge of the single sheet.

This paper-aligning device works as follows:

After the actuation of the coupling K, the uppermost sheet of the paper stack in the paper stock container V1 is drawn off by means of the paper rollers P1 and transported on a sliding track GL in the feed channel 11. Now it can happen that the single sheet, by being drawn off from the stack, does not slide exactly in a straight line relative to the sliding track GL, but is transported obliquely. This would result in an oblique printing image. The sensing device LS1 detects the leading edge of the transported single sheet E and at this instant cuts off the drive of the paper rollers P via the printer control. The brake contained in the coupling K brings the paper roller P to a stop immediately. However, the transport of the single sheet E on the sliding track GL is maintained by the preceding paper rollers P1 of the stock container. The leading edge of the single sheet E consequently butts against the stationary paper rollers P and arches according to the illustration of FIG. 5. As a result of continued transport, the paper is aligned along its leading edge via the paper rollers P. After a specific time, the paper rollers P1 of the stock container are deactivated and the paper rollers P are driven again. The single sheet E thus aligned is transported via the paper rollers P, and a freewheel, not shown here, arranged in the coupling K of the pair of paper rollers P1 makes it possible to draw the single sheet out of the paper rollers P1.

Turning device (FIG. 6)

So that the single sheet can be turned in the duplex mode, the printing apparatus of FIG. 1 contains two turning stations W1 and W2. A pair of paper rollers P10, as shown in FIG. 6 is arranged at the entrance of the turning station A further pair of paper rollers P11 is arranged in the middle of the turning station. Furthermore, the turning station has a paper channel PK which consists of two metal sections. The paper channel PK is widened in a funnel-shaped manner in the entry region of the turning device. A further paper channel PK follows the pair of paper rollers P11.

The pair of paper rollers P10, like all the pairs of paper rollers, is driven by a motor M via a toothed belt. It can be cut out and cut in via an appropriate coupling. Its construction corresponds in principle to the construction of the pair of paper rollers P1 of FIG. 5.

If, for example, a single sheet E is fed to the turning device W2 via the duplex channel DUK, the pair of paper rollers P10 transports the single sheet into the paper channel PK, the rear wall of the paper channel PK deflecting the paper so that it slides into the paper channel PK. The single sheet E, after passing through the paper channel PK, is grasped by the pair of paper rollers P11 and transported further until the end of the single sheet leaves the pair of paper rollers P10. As a result of the inherent flexibility of the paper sheet E, the latter aligns itself at the end in such a way that it slides past the pair of paper rollers P10 and assumes a position parallel to the paper channel PK.

The direction of movement of the paper rollers P11 is now reversed, and the paper rollers P11 push the single sheet past the paper rollers P10 into the output channel AK or, at the turning device W1, into the printing channel DK.

To generate the forward and backward movement of the single sheet, the paper rollers P11 are coupled to a gear which has a construction corresponding to FIG. 7. The gear contains a first coupling K1 dependent on direction of rotation and a second coupling K2 dependent on direction of rotation. The couplings are connected on the drive side to the motor M2 via a toothed belt Z1. On the driven side, the coupling K1 has a driven wheel of larger diameter than the coupling K2. The two driven wheels are connected to the driving roller SW2 of the pair of paper rollers P11 via a toothed belt Z2. The couplings K1 and K2 are actuated alternately, so that when the coupling K1 is actuated the coupling K2 is disengaged and when the coupling K2 is actuated the coupling K1 is disengaged. With the motor M2 rotating and the coupling K2 actuated, the toothed belt Z2 moves in the direction of the arrow shown in the coupling K2, and the single sheet E is drawn into the paper channel PK at a lower speed. After deactivation of the coupling K2 and actuation of the coupling K1, the movement of the toothed belt Z2 is reversed according to the direction of the arrow shown in the coupling K1, of the size of the driven wheel at the coupling K1 the single sheet E is pushed out into the output channel AK at high speed.

Delivery container (FIG. 8)

The delivery containers AB1 and AB2 of FIG. 1, which are shown generically as a delivery container AB in FIG. 8, are suitable for receiving different paper formats. They have at their entrance a pair of paper rollers P12 which transports the single sheets fed from the output channel AK into the delivery container AB1. So that the single sheets can easily be extracted from the delivery container AB when there are different formats, the single sheets are deposited flush with the rear wall R of the delivery container AB. The delivery takes place by depositing the first sheet to be delivered in the delivery container with the front side face-down.

So that the delivery of different paper formats can be carried out, the delivery container AB has a guide device LT. This guide device consists of a guide plate 21, pivotable via a lifting magnet 20 and having an additional paper-transport roller 22.

In the lowered state of the guide plate 21, as shown, paper sheets of smaller size are introduced in such a way that they come into engagement with the paper-transport roller 22. This paper-transport roller 22 grasps the single sheet and accelerates it again, so that it comes up against the rear side R of the delivery container AB in free flight.

For stacking papers of larger formats (such as Din A3size paper), the guide plate 21 is pivoted upwards (as represented by broken lines). The single sheets are thereby deflected and guided past under the paper-transport roller 22. Because of their size, they can be transported almost up to the rear wall AB by the paper rollers P12.

Storage device (FIG. 9)

Instead of an elongate simplex channel SK for the reception and storage in series of the single sheets printed on one side, it is also possible to provide a storage arrangement corresponding to that of FIG. 9. This consists in principle of a storage container SB, to which single sheets E are fed on one side via paper-transport elements (paper rollers P). These single sheets deposited in the storage container SB can then be extracted again via paper-transport elements P located at the bottom of the storage container SB on the exit side.

Switch (FIG. 10)

So that the single sheets can be fed to the various paper channels, whether duplex channel or simple channel, or for selecting the delivery containers AB1 or AB2, switches are arranged in the paper channels of the printing apparatus PW1 to PW4. These switches have a construction corresponding to that of FIG. 10. They consist, in principle, of a guide element 24 actuable via a lifting magnet 23 and arranged pivotably in the paper channel PK in such a way that, in a first state represented by unbroken lines, it leaves paper fed to the paper channel from above uninfluenced, so that it is not deflected. Where the switch PW2 is concerned, the paper slides in this case into the simplex channel SK. If the lifting magnet 23 is activated, the guide element 24 consisting of a guide plate pivots into the paper channel PK, and the single sheet is deflected into the duplex channel DUK, for example where the switch PW2 is concerned. The lifting magnet is at the same time moved counter to a spring 25 which, after the lifting magnet 23 has been cut off, returns the guide element 24 to its initial position again.

Control (FIGS. 11 to 13)

The control for the page printer is basically divided into a controller part C and the actual apparatus control G. The controller C is basically constructed according to U.S. Pat. No. 4,593,407. It has the function of receiving printing data coming from a computer H, preparing these page for page in page form and activating the character generator 13 of the printing station as a function of the characters to be represented. The apparatus control G in turn serves for the coordinated flow of all the printer functions. It is of modular construction and consists of a main processor HP and of various submodules SUB1 to SUB5 which guarantee an independent monitoring of the associated printer units. Communication between the individual control parts takes place via a hardware/software interface, uniform for all the parts, (network coupling, serial bus). Each submodule SUB1 to SUB5 is equipped with its own processor, can tend the associated unit of the printing apparatus independently and is self-testable. This self-testability means that independent test routines are executed both when the apparatus is switched on and on the demand of the main processor HP. All the modular control subassemblies of the printer in the apparatus control are registered in terms of their status in a non-volatile memory. The controller can have access to these values. Moreover, the content of the non-volatile memory can be printed out, as required. Furthermore, there are interfaces for accessories.

FIGS. 11 and 12 show the basic construction of the apparatus control in the form of a block diagram. FIG. 12 illustrates a block diagram of the construction of the main processor HP.

All the submodules SUB1 to SUB5 and the main processor HP are connected to one another by means of a serial interface INT1 which is controlled via line drivers. The serial interface INT1 is controlled under the supervision of the main processor HP via a BIT bus. The interface log corresponds to the conventional HDLC/SDLC description (high-speed data transmission). To relieve the interface and to simplify the cabling to the individual units, the units are controlled by the associated submodules SUB1 to SUB5 directly via power amplifiers not shown here. The main processor HP checks the functioning of the individual submodules SUB1 to SUB5 at periodic intervals. A monitoring circuit (hardware/watchdog) checks the flow in the main processor. The synchronization of the flow control with the circumferential speed of the photoconductor drum 12 takes place via the output signals F from a rotary pulse transmitter DI. The output of this rotary pulse transmitter DI (FIG. 2) is connected to all the submodules SUB1 to SUB5 and supplies a synchronizing signal F at cyclic intervals.

According to FIG. 12, the main processor has the following construction:

A central unit CPU is connected to three memories SP1 to SP3 and to an input/output unit EA. The memory SP1 is a read/write memory, the memory SP2 is an electrically programmable read-only memory and the memory SP3 is a non-volatile data store. The input/output unit EA receives, among other things, the synchronizing pulse F.

The non-volatile memory SP3 stores consumption-material changes, printed/fixed pages, maintenance intervals, error statistics and deviations from standard values entered by the operator, etc. The connection to the controller C is made via a conventional interface INT2.

The main processor HP has the task of coordinating all the messages, instructions and measurement data of the outer stations SUB1 to SUB5, checking them for plausibility and transmitting them. Furthermore, it makes the connection with the controller C via the interface INT2 and the system bus BUS2. Bidirectional commands and messages are sent in this way. The proper program flow in the apparatus control is monitored continuously via the monitoring circuit U (watchdog circuit).

As already explained, five submodules SUB1 to SUB5 perform the independent monitoring and control of the units assigned to them. Communication between the individual modules SUB1 to SUB5 and the main processor HP is made via a hardware/software interface INT1, which is the same for all the parts. Each submodule has its own processor with input buffer, which transmits to the processor the data supplied via the input I, and power stages which drive the associated units via the output O. The submodules are self-testable, that is to say test routines are executed automatically both when the apparatus is switched on and in response to the main processor HP.

The submodule SUB1 monitors all the sensors LS of the stock containers V1 to V3, the feed channels 11 and of the printing channel DK and at the same time especially the start-of-print signal of the sensor LS SYN. The submodule SUB1 controls all the units in this region. It detects and communicates paper-run faults.

The submodule SUB2 covers all the sensors LS in the paper-output region, that is to say the region of the output containers AB1, AB2 and of the waste container AF and in the output channel AK. Paper-run faults are detected and communicated to the main processor HP.

The submodule SUB3 monitors the sensors LS in the simplex and duplex channels DK and SK and in the return channel RF. It controls the paper run in these channels and detects paper-run faults.

The submodule SUB4 controls the indicator device AZ on the printer. The indicator control panel AZ contains a keyboard and an indicator device (FIG. 3), the paper run in the printer or, in the event of a paper-transport fault, the fault location being displayed via the indicator device. The submodule SUB4, in conjunction with the control panel AZ, represents the interface between the operator or maintenance technician and the printing apparatus. All the entries made by the operator and all the information from the apparatus are obtained via the control panel. This consists essentially of a display for indicating the information and of a keyboard for entering various instructions and parameters. Furthermore, it has some special operating and indicator elements.

An essential function of the indicator device for the paper run on the control panel is the indication of paper-transport faults.

The paper run is monitored continuously via the sensors LS. If a transport fault occurs, this is shown on the paper-run diagram of the control panel. The place of the fault can therefore be located automatically. The operator can thus rectify the transport fault without any loss of time.

To guarantee a continuous printing operation, when printing has resumed after the fault has been rectified a new single sheet reproducing the content of the destroyed single sheet is printed immediately. All the single sheets located in the printing apparatus between the fault location and the printing station are likewise reset, thus guaranteeing that the single sheets will be deposited correctly in the delivery container AB1 or AB2. The surplus single sheets between the fault location and the printing station are automatically transported to the waste container AF.

The sensors of the printing station DS are covered by the submodule SUB5. These are, for example, temperature sensors and microswitches in the fixing station, transport-monitoring sensors in the developer station, etc. The submodule SUB5 controls the units, the fixing lamps, motors, fans, loading checks, etc. The faults which occur are communicated to the main processor HP.

Instead of activating the control panel AZ via the submodule SUB4, it is also possible to activate the control panel directly via the main processor HP. There is then no need for the submodule SUB4.

Functional description:

As stated in the introduction, the page printer is designed for simplex, duplex and mixed operation. The printing data for the individual pages are hereby fed from the external computer H to the controller C of the page-printing apparatus in the front side/reverse side sequence. To guarantee continuous printing operation at a constant process speed, in this case 50 pages per minute, the entered printing data must be intermediately stored page for page in a page memory PM of the controller C as a function of the length of the printing channel DK, the return channel RF and the process speed.

In the exemplary embodiment illustrated, at the printing capacity required and with the dimensions of the return channel and printing channel, two front-side stores are needed in the simplex mode and additionally three reverse-side stores for duplex operation. In the mixed mode, that is to say with a mix of duplex and single sheets, this requirement varies according to the printing sequence. To have some redundancy available, the page store PM is designed for seven pages.

Furthermore, the page-printing apparatus is designed for printing on different paper formats. Thus, for example, single sheets of the printing format A4 can be used in the stock container V1 and single sheets of the format A3 in the stock container V2. It is even possible to use different paper sizes within a stack. The size of the photoconductor drum 12 is such that a paper of A4 size can be printed with it during a normal revolution. If a single sheet of A3 size is to be printed, two printing images of A4 size are applied in succession to a single sheet of A3 size by means of the photoconductor drum 12 in the transfer-printing station 5.

The printing process as such will first be described by reference to the simplex mode in the A4 format.

Each stock container V1 to V3 contains sensors LS2 in the region of its paper-transport elements P1 to P3. These sensors LS2 detect the level of the stack. If there is no single sheet in the access region of the paper-transport rollers P1 to P3, the stack is advanced automatically via the lifting table 10. The single sheet detected via the sensors LS2 is then pushed forwards by means of the paper-transport rollers P1 to P3 as far as a light barrier LS3. This light barrier LS3 defines the standby position of the single sheets before entry into the feed channel 11 or the printing channel DK. Since the stock containers V1 to V3 have different positions in the printer, but the single sheets have to cover the same distance in the feed channel 11 for reasons of synchronization, the light barriers LS3 defining the standby position are the same distance away from the entrance of the printing channel DK.

At the instant in time TO, the printing apparatus is in the standby mode, and the page stores are emptied. At this instant in time, the computer H begins to send the data for page 1. The printer stores the data for page 1 in a first storage region of the page store PM and transports sheet 1 from the standby position in the direction of a position defined by the location of the light barriers LS SYN. The sensor LS SYN consists of two sensing elements, namely a sensing element for the leading edge of the single sheet and a sensing element which detects the presence of the single sheet. The synchronizing position is defined as the drum portion of the photoconductor drum 12 from the character generator 13 to the transfer-printing station 15 round into the printing channel.

At the instant T1, the computer begins to send data for page 2. The page printer stores the data for page 2 in a second storage region of the page store PM and transports sheet 2 from the standby position in the direction of the synchronizing position LS SYN. At the instant T2, the sheet 1 has reached the synchronizing position. Simultaneously, the printer writes the printing data out of the first storage region of the page store PM onto the photoconductor drum 12.

At the instant T3, the last datum has been written out of the first storage region of the page store PM onto the drum, and the computer H begins to send data for page 3. The page printer stores the data for page 3 in the now empty first storage region of the page store PM and transports sheet 3 from the standby position in the direction of the synchronizing position.

The printed sheets are transported via the suction table S into the fixing station F and fixed there. Their position is sensed continuously by the light barriers LS in the printing channel DK.

Since single sheets in the simplex mode are concerned, the single sheets are fed via the switch PW1 to the pair of paper rollers P21 which transports the single sheets into the simplex channel SK by means of the switch PW2 at the process speed. In the simplex channel SK, the single sheets are moved via the paper-transport rollers P22, P23, P24, P25, P26 into the turning device W2 and from there, without any turning operation, into the output channel AK by means of the paper rollers P28 and P29, the switches PW3 and PW4, and into the delivery container AB1 or AB2 and the waste container AF. So that the length of the simplex channel can be compensated, or so that a reliable depositing of the single sheets into the delivery container AB1 and AB2 can be ensured, in the turning device W2 the single sheets are accelerated to a higher speed via the pairs of paper rollers P11 arranged there. So that this acceleration can occur reliably, the pair of paper rollers, in this case the pair of paper rollers P26, arranged immediately in front of such an acceleration zone, has a freewheel. The single sheet can thereby be drawn out of the pair of paper rollers P26 working per se at process speed. The paper rollers P27, P28 and P29 in the output channel work at increased speed. Each of the pairs of paper rollers P in the simplex channel SK can be controlled individually via couplings.

To obtain the full printing speed of the page printer, the distance between two printed A4 pages should not exceed a specific distance, for example 54 mm in this case. However, the printing process and therefore the draw-in of the paper from the stock containers V1 to V3 can begin only when the respective storage region of the page store PM is fully written. This would mean that the distance from the paper input compartment (V1 to V3) to the synchronizing point LS SYN should likewise not exceed 54 mm. For reasons of construction, however, it is not possible to bring three stock containers to this distance. However, the distance of 54 mm can be avoided if, as early as at the entry of the first datum, the paper is conveyed from a standby position in the direction of the synchronizing point LS SYN. If the data transmission time of the connected computer is shorter than the cycle time of 60/50 Seconds=1.2 seconds (printing capacity of 50 pages per minute) for an A4 sheet size, the printing process is initiated when the respective sheet has reached the synchronizing point LS SYN. If the data transmission time is longer than the cycle time (1.2 seconds), the sheet is stoped shortly before the synchronizing position and conveyed further only when the respective page store is fully written. When the synchronizing point LS SYN is reached, the printing process is then initiated.

The standby position of the paper is calculated as follows: at the instant T3=T0+2.4 seconds, the first storage region of the store PM must have been emptied. At a process speed of 220 mm per second and an A4 printing length of 210 mm, a printing time of 210/220 seconds=0.955 seconds is obtained. There therefore remain for the transport of the paper from standby position to synchronizing position T=2.4 seconds−0.955=1.45 seconds. This gives a distance of 318 mm. In the abovementioned calculation, additional delay times, such as, for example, switching times of couplings, are not taken into account.

Since it is not possible, for reasons of construction, to bring the three input stores V1 to V3 into this position, one sheet from all three input compartments is "advanced" into this standby position LS3.

Printing of larger paper formats

Since an A3 paper format has to be processed by follow-up printing, the printing capacity is 25 pages per minute. The cycle time is therefore 2.4 seconds. Two A4 page stores are available for writing the paper format A3. This means that the first A3 half-page is written into the first storage region of the page store PM and the second A3 half-page is written into the second storage region of the page store PM. However, the drum can be written with data only when the A3 page has been transmitted completely. On the other hand, the data transmission of the next page can begin only when the two storage regions have been emptied. The data transmission time for 25 pages per minute of A3 is obtained as follows:

cycle time T=2.4 seconds printing time for 420 mm=420/220 seconds=1.91 seconds.

There therefore remain for the transmission of the second half-page 2.4 seconds−1.91 seconds=0.49 seconds or, over a full A3 page, 2×0.49 seconds=0.98 seconds.

Duplex mode

In the duplex mode, both the front side and the reverse side of the single sheets are printed.

The feed of the single sheets from the stock containers V1 to V3 to the printing station corresponds to the simplex mode. However, it is necessary to provide a larger storage space for the page store PM.

The computer H supplies the data for the printing sides in the following sequence: front side of sheet 1, reverse side of sheet 1, front side of sheet 2, reverse side of sheet 2, etc. The sequence of the printing process is different, however, since the single sheets to be printed on both sides must, after the front side has been printed, be fed to the printing station once again via the return channel RF.

In the duplex mode for printing an A4 paper format, the sequence of the sides supplied by the computer is therefore as follows:

front side of sheet 1, reverse side of sheet 1, front side of sheet 2, reverse side of sheet 2, etc.

On the assumption that eight single sheets are printed in the duplex mode, the following sequence is obtained: front side of sheet 1, front side of sheet 2, front side of sheet 3, front side of sheet 4, reverse side of sheet 1, front side of sheet 5, reverse side of sheet 2, front side of sheet 6, reverse side of sheet 3, front side of sheet 7, reverse side of sheet 4, front side of sheet 8, reverse side of sheet 5, reverse side of sheet 6, reverse side of sheet 7, reverse side of sheet 8. Thus, after the printing of the front side of sheet 4, there is an alternating printing of front side, reverse side, front side, reverse side, etc, in order to obtain a better utilization of the computer interface. To achieve the maximum printing capacity of 50 pages per minute, that is to say 25 sheets printed on both sides, five storage spaces for pages must therefore be provided in the page store PM. Whilst one space of the page store is regularly occupied by the front sides of the single sheets, four spaces of the page store PM are occupied by four reverse sides. In particular by the reverse sides of sheet 1, the reverse sides of sheet 2, the reverse sides of sheet 3 and the reverse sides of sheet 4. There then follow the reverse sides of sheet 5, the reverse sides of sheet 6, the reverse sides of sheet 7 and the reverse sides of sheet 8.

A diagram of the print in the duplex mode is shown in FIG. 13*a, b*. In this, the designations BPM1, BPM2, BPM3, PM1, PM2 denote the individual pages of the page store PM. "Print" designates the print a the transfer-printing station and "data" denotes the computer data entered by the computer H. VS1 to VS8 are the front sides of the sheets 1 to 8 and RS1 to RS8 are the reverse sides of the sheets 1 to 8. DVS1 to DVS8 are the computer data (lacuna) front sides of sheets 1 to 8 and DRS1 to DRS8 are the computer data of the reverse sides of sheets 1 to 8. The diagram indicates the occupation of the stores PM by the written data against the time t in seconds or the cycle time T.

The run of the single sheets in the duplex mode through the printing apparatus is, in principle, as follows: after the printing of the front side of the first sheet, this sheet, after running through the fixing station F, is deflected by the switch PW1 into the return channel RF and is drawn into the return channel RF by the paper rollers P5 at the process speed. After the paper-transport rollers P6 have been reached, the paper is accelerated to a higher speed by these paper-transport rollers. The paper-transport rollers P5 contain a free-wheel, so that the single sheet can be drawn directly out of these paper rollers P5. The single sheet is introduced into the turning station W1 at this increased transport speed. There, it is stopped, as described, and the transport direction reversed. At reduced process speed, after being turned it is fed once again to the printing channel DK via the paper-aligning device PA. It can be taken from the diagram of FIG. 13*a, b* that, during the printing of the front side of the sheet 4, the reverse side of sheet 1 has already run through the turning station W1 and is at the synchronizing position LS SYN. After the printing of the reverse side of sheet 1, the front side of sheet 5, which has been fed from the stock regions, is at the synchronizing mark LS SYN, etc. After the printing of the reverse side, for example the reverse side of sheet 1, sheet 1 is fed once again via the fixing station F to the switch PW1. This now guides sheet 1 into the duplex/-simplex channel system, and it is fed to the switch PW2 via the pair of paper-transport rollers P21 at process speed. The switch PW2 guides the sheet 1 printed on both sides into the duplex channel DUK. There, it is accelerated by the pair of paper rollers P31 and fed at increased speed to the turning device W2 via the pairs of paper rollers P32, P33, P34. This turning device once again turns over the sheet 1 printed on both sides. It is then deposited in the delivery container AB1 or AB2 via the output channel AK and the switches and paper rollers arranged there.

As described at the beginning, the arrangement of the second turning station W2 makes it possible, in the form-printing mode, to deposit the sheets in the stock containers V1 to V3 with the front side face-up, irrespective of whether simplex or duplex mode is in use. At all events, this ensures that delivery takes place in the correct sequence in the delivery containers AB1 or AB2, with the front side face-down.

A reversal of the sequence in the stock container necessitates a reversal of the sequence in the delivery container.

The arrangement of the duplex and simplex channels as separate channels, in conjunction with a second turning device, also makes it possible to print continuously at a constant process speed in the mixed mode, followed by three sheets with simplex printing, and thus, after the printing of the front side of the first sheet, the sheet is returned via the return channel RF and turned in the turning station W1. However, the following simplex sheets are transported into the simplex channel SK. There they are stored in the sequence E1, E2, E3, for example as shown in FIG. 2. This is possible because each of the paper rollers in the simplex channel can be controlled directly via a coupling. After the finished first duplex sheet has run through the duplex channel DUK at increased speed and the sheet has been turned in the turning station W2, the duplex sheet is deposited at increased speed in the delivery containers AB via the output channel AK, followed by the single sheets E1, E2 and E3 likewise accelerated to an increased transport speed in the switch W2.

This sequence is only an example, and it can be varied as desired. At all events, there is the guarantee that, as a result of the arrangement of the channels and of the turning station, a continuous process speed can be maintained, even in mixed duplex and simplex mode, because only the pages to be printed are guided past the transfer-printing station 15. In the printing apparatus, it is possible, even in the mixed duplex and simplex mode, to process large and small paper formats separately or together (DIN A4, DIN A3). In the duplex mode for A3 paper formats, the A3 page is divided into two A4 pages and filed in page stores. The printing process begins only when the two stores are fully written. The flow for the printing of the reverse side of an A3 format is similar.

Although other modifications and changes may be suggested by those skilled in the art, it is the intention of the inventors to embody within the patent warranted hereon all changes and modifications as reasonably and properly come within the scope of their contribution to the art.

We claim:

1. A printing apparatus for printing one or both sides of single sheets fed consecutively to the printing apparatus in a mixed sequence of single sheets to be printed both on one side and on both sides, comprising:

a) a printing channel with an associated printing station and paper-transport elements, said printing channel having entry and exit sides;

b) a return channel coupled to said printing channel on said entry and exit sides which has paper-transport elements and a turning device and which, on demand, after printing of a front side of the single sheets feeds the single sheets to the printing station once again for printing of a reverse side of the single sheets;

c) a paper-transport channel system coupled to said printing channel and having paper-transport elements and a separate duplex channel and a simplex channel for separate transport of the single sheets printed on both sides or on one side into a common output channel;

d) a paper storage device associated with said simplex channel for storing a single sheet printed on one side;

e) a control means for controlling an output sequence of the single sheets to the common output channel by storing a single sheet printed on one side following a single sheet printed on both sides in the sequence of printed single sheets in the paper storage device, until the single sheet printed on both sides has run through said duplex channel.

2. A printing apparatus according to claim 1, wherein said paper storage device is a storage channel receiving the single sheets consecutively.

3. A printing apparatus according to claim 1, wherein said paper storage device comprises a storage container, said storage container having paper extraction and paper-feed elements.

4. A printing apparatus according to claim 1, wherein one of said duplex channel and said output channel has a further turning device.

5. A printing apparatus according to claim 1, further comprising: a feed channel connected to said printing channel and having a paper-aligning device, whereby the single sheets extracted from stock containers are positioned in said paper-aligning device and then fed to said printing channel.

6. A printing apparatus according to claim 1, further comprising: a paper-aligning device arranged in the printing channel in front of said printing station.

7. A printing apparatus according to claim 5, wherein said paper-aligning device comprises a motor-driven pair of paper rollers, a paper-position sensor mounted preceding said pair of paper rollers in a paper-transport direction, paper transport elements mounted preceding said paper position sensor in the paper transport direction, and a control means for pressing a leading edge of the single sheet against said pair of paper rollers via the paper transport elements while the pair of paper rollers is stationary, as a function of an output signal from the paper-position sensor for a predeterminable aligning time and for transporting the single sheet thus aligned further by said pair of paper rollers.

8. A printing apparatus according to claim 1, further comprising: paper-transport elements of variable transport speed and reversible transport direction comprising a pair of rollers having a pressure roller and a transport roller, a first and a second electrically actuable coupling, a drive motor being coupled via drive means to a driving side of the couplings and said transport roller being coupled via drive means to said driven side of the couplings.

9. A printing apparatus according to claim 1, further comprising: paper-transport elements comprising a driving roller made of metal and a pressure roller made of flexible elastomeric material.

10. A printing apparatus according to claim 1, wherein said return channel includes means for transporting the single sheets at a speed substantially higher than a printing process speed.

11. A printing apparatus according to claim 1, further comprising: paper-position sensors arranged in said paper-transport channels and mounted to detect a position of the single sheets.

12. A printing apparatus according to claim 11, further comprising: an indicator device displaying paper transport channels and connected to display a fault location via said paper position sensors if there is a fault in the printing operation as a result of defective paper transport.

13. A printing apparatus according to claim 1, further comprising: a separately controllable waste/delivery container.

14. A printing apparatus according to claim 1, further comprising: a delivery container for different paper formats, said deliver container including paper-transport elements arranged on an entry side of said delivery container, a stop edge, additional paper transport elements and a pivotable guide device which, as a function of paper format, transports single sheets of large paper formats to said stop edge directly and single sheets of small formats to the said stop edge via the additional paper-transport element.

15. A printing apparatus according to claim 6, wherein said paper-aligning device comprises a motor-driven pair of paper rollers, a paper-position sensor mounted preceding said pair of paper rollers in a paper-transport direction, paper transport elements mounted preceding said paper position sensor in the paper transport direction, and a control means for pressing a leading edge of the single sheet against said pair of paper rollers via the paper transport elements while the pair of paper rollers is stationary, as a function of an output signal from the paper-position sensor for a predeterminable aligning time, and for transporting the single sheet thus aligned further by said pair of paper rollers.

* * * * *